US005155537A

United States Patent [19]

Komatsu et al.

[11] Patent Number: 5,155,537

[45] Date of Patent: Oct. 13, 1992

[54] SHEET FEEDING APPARATUS WITH A PLURALITY OF EASILY LOADED CASSETTES

[75] Inventors: Teruo Komatsu; Yasuyoshi Hayakawa; Hironobu Isobe, all of Yokohama; Atsushi Kubota, Tokyo, all of Japan

[73] Assignee: Canon Kabushiki Kaisha, Tokyo, Japan

[21] Appl. No.: 439,579

[22] Filed: Nov. 21, 1989

[30] Foreign Application Priority Data

Nov. 22, 1988 [JP] Japan ..... 63-296736
Dec. 16, 1988 [JP] Japan ..... 63-317701
Jan. 23, 1989 [JP] Japan ..... 1-13543

[51] Int. Cl.[5] ..... G03G 15/00; B65H 1/26
[52] U.S. Cl. ..... 355/309; 271/9
[58] Field of Search ..... 355/308, 309, 206; 346/160; 271/8.1, 9, 10, 256, 258, 264, 265

[56] References Cited

U.S. PATENT DOCUMENTS 4,605,215 8/1986 Hyltoft ..... 355/309 X
4,941,002 7/1990 Maruyama et al. ..... 346/160
4,958,822 9/1990 Rutishauser et al. ..... 271/9
4,966,356 10/1990 Ohyaba et al. ..... 271/9

FOREIGN PATENT DOCUMENTS 0256859 2/1988 European Pat. Off. .
59-4534 1/1984 Japan .
61-86335 5/1986 Japan .
2086359 5/1982 United Kingdom .
2216501 10/1989 United Kingdom .

*Primary Examiner*—Joan H. Pendegrass
*Attorney, Agent, or Firm*—Fitzpatrick, Cella, Harper & Scinto

[57] ABSTRACT

The present invention provides a sheet feeding apparatus comprising: a first sheet accommodating means shiftable in a predetermined position from a sheet supply position for supplying a sheet, a first sheet supply means for feeding out the sheet from the first sheet accommodating means positioned in the sheet supply position, a feeding means for feeding the sheet fed out by the first sheet supply means, a second sheet accommodating means for accommodating sheets, a second sheet supply means for feeding out the sheet from the second sheet accommodating means, a guide means movable between a first position intersecting a moving path of the first sheet accommodating means and where guiding the sheet fed out by the second sheet supply means to the feeding means and a second position where not guiding the sheet, a detecting means for detecting the passage of the sheet through the guide means and for emitting a detection signal, and an inhibiting means for inhibiting the movement of the first sheet accommodating means in response to the detection signal from the detecting means.

34 Claims, 12 Drawing Sheets

SHEET FEEDING APPARATUS WITH A PLURALITY OF EASILY LOADED CASSETTES

BACKGROUND OF THE INVENTION

1. Field of the Invention

The present invention relates to a sheet feeding apparatus for feeding a sheet material (for example, a transfer member) used with an image forming system such as a copying machine, printer and the like.

2. Related Background Art

The image forming system to which the present invention is applicable may be an electrophotographic copying machine, a laser beam printer, a printer using a liquid crystal shutter or an LED array, and the like.

Among these image forming systems, the laser beam printer using a laser beam (referred to as "L.B.P." hereinafter) has recently been progressed remarkably, since it provides a good image with high quality and less noise in its operation. Also in the market, the L.B.P. has been required to have a more improved function and more multiple functions. The present invention aims to provide an image forming system having an improved sheet feeding apparatus which meets one of the requirements, i.e., can solve a problem arisen when a plurality of cassette accommodating means is arranged in the system.

FIG. 9 is a sectional view of a conventional L.B.P. (laser beam printer) having a single cassette accommodating means.

This L.B.P. improves the sheet holding feature and sheet feeding ability by feeding a sheet in a substantially vertical sheet feeding path and by shortening the sheet feeding path. With this arrangement, the jamming of the sheet can be reduced and the sheet feeding ability and the reliability of operation can also be improved, since the sheet feeding direction is not varied abruptly. Further, in this L.B.P, as a whole, mechanical parts such as driving elements are arranged in the left side (FIG. 9) of the L.B.P, and electrical and optical parts are arranged in the right side of the L.B.P. With this arrangement, the treatment of the jammed sheet and the maintenance can be easily performed, and the size and the cost of the printer can also be reduced.

The construction and operation of the L.B.P will now be explained with reference to the example shown in FIG. 1.

In FIG. 9, a frame 1 of the printer includes a stationary part 1A and a rockable part 1B which can be opened to expose a sheet feeding path for a sheet S. The rockable part 1B is supported for pivotal movement around a pivot pin 2. The sheets S are accommodated in a cassette 3 acting as a sheet accommodating means and are fed out from the cassette 2 by means of a sheet supply roller 4. When, the sheet supply roller is rotated, the sheets S are separated one by one by means of the sheet supply roller and a separating pad 4 made of high friction material and urged against the sheet supply roller 4.

The separated sheet S is fed to a pair of registering rollers 7 along a pair of guides 6, and then is passed in front of an image bearing member 8 in synchronous with an image formed on the image bearing member. Thereafter, the sheet is transported to a transfer station along a transfer guide 25. The transfer station includes the image bearing member 8 and a transfer roller 9 urged against the image bearing member. The image on the image bearing member 8 is transferred onto the sheet S in the transfer station, and then, the sheet is fed to a fixing device 10.

The fixing device 10 comprises a heater roller 11 including a heater therein, a pressure roller 12 for urging the sheet S against the heater roller 11, a guide 13 for introducing the sheet S into a nip between the heater roller 11 and the pressure roller 12, a casing 14, and a separating pawl or claw 15. After the image has been fixed to the sheet S by means of the fixing device 10, the sheet S is ejected through an ejection opening 1C and collected in a tray 16. Further, by changing over a flapper 17 arranged between the fixing device 10 and the ejection opening 1C, the sheet feeding direction can be changed, whereby the sheet can be ejected through an ejection opening 1D. Incidentally, in this case, the surface of the sheet on which the image is formed is turned to the upside.

Next, an image forming station will be explained. The image forming station can perform a well-known Carlson processes and includes a process cartridge 18 enclosing various elements for executing the processes, and a scanner 19 for scanning the image bearing member 8 axially with a laser beam.

The process cartridge 18 will be explained with more detail. The image bearing member 8 is charged uniformly a charger roller 20, and a latent image is formed on the image bearing member by a laser beam L emitted from the scanner 19. Toner t in a developing container 21 is supplied to a developing station 23 by an agitating plate 22 and is coated on a developing sleeve 24 to form a thin toner layer. The toner is sticked or adhered to the image bearing member 8 in accordance with the image formed thereon to develop the image. This toner image is then sent to the transfer station mentioned above.

Next, the cassette 3 acting as the sheet accommodating means will be explained. The cassette 3 is arranged in a lower portion of the printer. If a plurality of cassettes are used, the cassettes are arranged in a overlapped condition. A direction to which the cassette is loaded or unloaded to replenish the sheets may coincide with a direction A in consideration of the fact that the sheet feeding path can be easily maintained and a mechanism for retracting the separating means 4, 5 can be conveniently provided when the plurality of cassettes are arranged in the overlapped condition. However, in this case, there arise problems that operations to be performed by an operator are more complicated and troublesome and that an installation space for the printer is considerably increased. That is to say, the operator must perform the jam treatment, exchange of the process cartridge 18 and manipulation of an operation panel in a direction Y (FIG. 9), whereas he must load or unload the cassette in the opposite direction A, and, accordingly, the operator must move to the opposite sides of the printer for performing these operations. In particular, the operator must move to the rear side of the printer whenever he performs the mainpulation regarding the cassette, which is to be most frequently performed. Further, since a space used for loading and unloading the cassette must be maintained in the rear side of the printer, the large installation space for the printer is required.

Incidentally, the Japanese Patent Laid-Open No. 59-4534 discloses a sheet feeding apparatus in which a cassette can be loaded and unloaded in a direction same as a sheet feed-out direction. However, this patent specification does not disclose the treatment of the cassette if a plurality of cassettes are used.

SUMMARY OF THE INVENTION

In order to solve the above problems, the present invention provides a sheet feeding apparatus in which a cassette can be loaded (or inserted) and unloaded in the direction Y to improve the operability. Particularly, the present invention eliminates the problems which are caused when a plurality of cassettes are used and which will be described below.

In general, when the cassette is unloaded or retracted, the cassette moves across a sheet feeding path, and, therefore guides for defining the sheet feeding means are so designed that the guides can be retracted away from the cassette moving path not to interfere with the cassette. In this case, when one of the cassettes is being loaded or unloaded, the sheet cannot be fed out from any cassettes situated upstream of said one cassette in the sheet feeding direction.

Therefore, when the printer is driven, the operator must go to the printer to ascertain the condition of the printer. In this case, particularly, if the same printer is used by several operators, since the printer is usually situated remotely from each operator, the ascertainment of the printer condition is troublesome for each operator.

Further, when any operator is unloading the cassette to change the size of the sheets or replenish the sheets, if other operator drives the printer, the jamming of the sheet occurs in the printer. Therefore, the timing of the change and replenishment of the sheets is very difficult.

Also in a copying machine, when the guide is retracted from the predetermined position to exchange the cassettes, the sheet cannot be fed out from any cassettes situated upstream of the retracted guide in the sheet feeding direction. If the operator drives the copying machine to feed the sheet from the upstream cassette without knowing such condition, the jamming of the sheet will occur.

In order to solve the above problems, according to the present invention a plurality of sheet accommodating means are provided, and it is designed that any sheet accommodating cannot be loaded and unloaded during the sheet feeding operation. Alternatively, an altering means for letting the operator know whether the cassette can be loaded and unloaded is provided.

Further, an object of the present invention is to prevent the sheet from being fed to a guide means when the latter is not situated in a sheet feeding position, thus preventing the jamming of the sheet.

In addition, a further object of the present invention is to provide a sheet feeding apparatus for an image forming system, wherein, if any cassette is unloaded, a sheet feeding path regarding upstream cassettes can be maintained by designing that the sheet feeding path is shiftable between an operative position and an inoperative or retracted position in response to the loading and unloading of the cassette (sheet accommodating means).

DETAILED DESCRIPTION OF THE PREFERRED EMBODIMENTS

The present invention will now be explained with reference to the accompanying drawings.

First of all, a preferred embodiment of the present invention will be described in connection with FIGS. 1 to 3.

Figure 1:
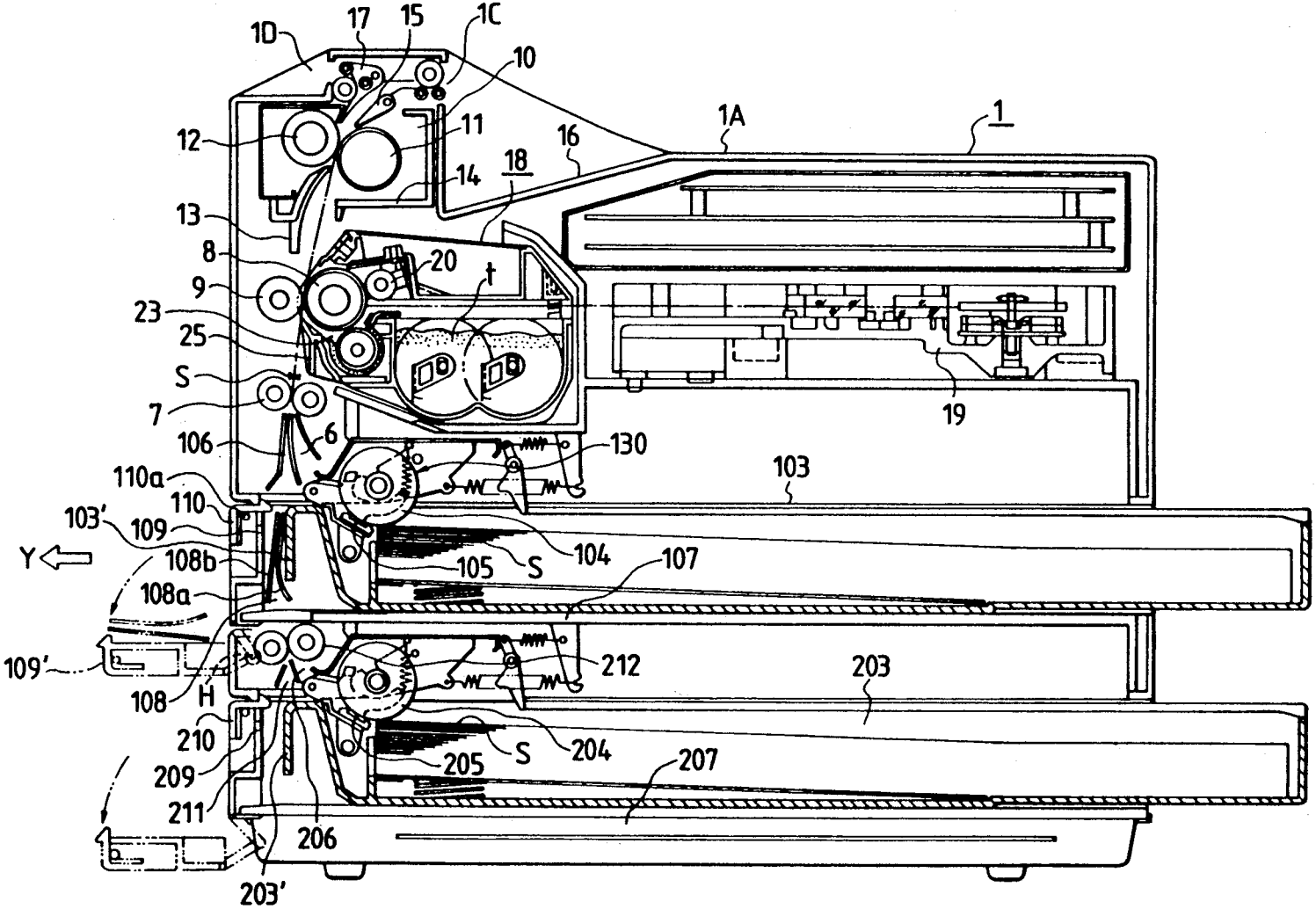
FIG. 1 is an elevational sectional view of an image forming system having multiple cassettes, to which the present invention is applied.
Figure 2:
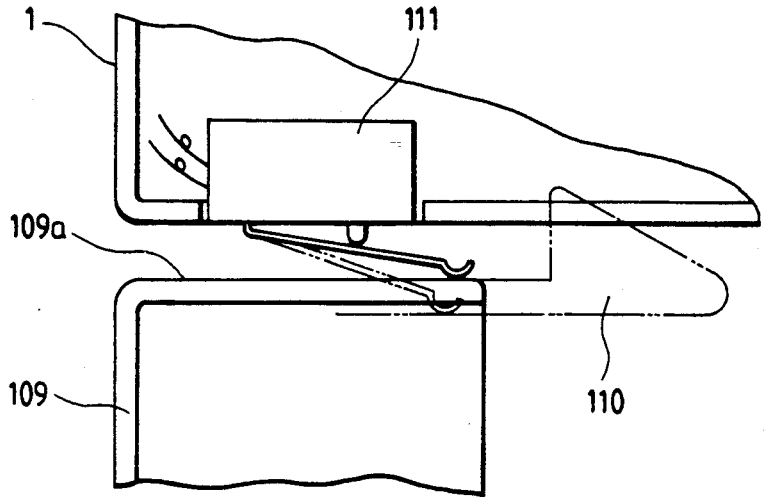
FIG. 2 is a partial sectional view showing an embodiment of the present invention.
Figure 9:
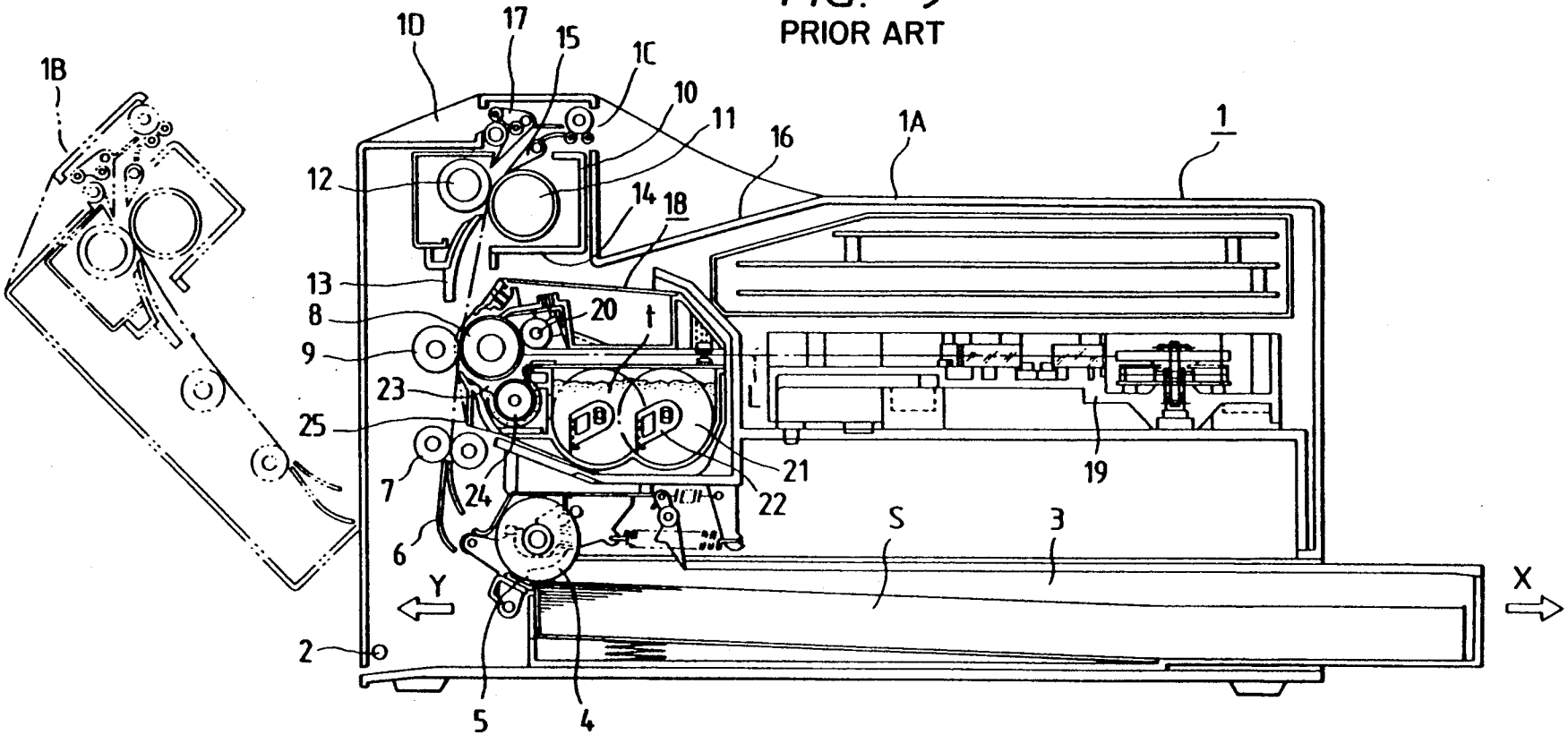
FIG. 9 PRIOR ART
FIG. 9 is an elevational sectional view of a conventional laser beam printer.

FIG. 1 shows an elevational sectional view of an image forming system incorporating a sheet feeding apparatus having a plurality of sheet accommodating means (in the illustrated embodiment, two sheet accommodating means are shown). The image forming system has the same construction as the conventional one shown in FIG. 9 in the area above the sheet accommodating means, and, thus, the constructural elements included therein are designated by the same reference numerals as used in FIG. 9. Further, since the operations of these elements is substantially the same as those of the system shown in FIG. 9, the explanation of such same operations will be omitted. The multiple sheet accommodating means will be explained herein.

As to an upper cassette 103 acting as an upper sheet accommodating means, the sheets S accommodated in the cassette 103 inserted into a sheet feeding position are separated and fed one by one by means of a sheet supply roller 104 and a separating pad 105 which constitute a sheet separating means, in the same manner as mentioned above. The separated sheet is then fed to a pair of regist rollers 7 along guide path 6, and thereafter is introduced into a transfer station. In the illustrated embodiment, the image forming system includes a further guide path 106 for guiding the sheet from a lower cassette 203 to the registering rollers 7. In the illustrated embodiment, while an example that both guide paths 6, 106 are defined by using a common guide plate was explained, these guide paths may be defined by discrete guide plates.

Returning to the upper cassette, in view of a cassette loading or unloading direction Y, a grip 103' is provided on a front wall of the cassette. An operator can load or unload the cassette 103 by gripping the grip 103' of the cassette in the direction Y while guiding the cassette along a cassette guide 107.

Next, the lower cassette 203 will be explained. The lower cassette 203 also has a grip 203' for loading or unloading the cassette. The sheets in the lower cassette are fed out and separated one by one by means of a sheet supply roller 204 and separating pad 205. The reference numeral 206 designates a guide path for guiding the sheet fed out by the sheet supply roller 204; 212 designates a feed roller for feeding the sheet to downstream guide paths 108, 106; and 207 designates a cassette guide for guiding the lower cassette 203 when it is loaded or unloaded.

Next, the loading and unloading of the cassettes will be explained. When the cassettes 103, 203 are loaded or unloaded in the direction Y, i.e., a direction to which the sheet is fed out from the cassette, a separating means 130 constituted by the sheet supply roller 104 and separating pad 105 must be retracted from the cassette moving path. As one of such separating means, the Applicant has proposed a separating means which could be retracted upwardly. Explaining such separating means with reference to FIG. 5, the sheet supply roller 104 of the separating means 130 is rotatably supported by a separating side plates 131, and the separating pad 105 is fixed to a lever 132 which is attached to the separating side plates 131 for pivotal movement around a pin 132*a* and which is biased by a spring 132*b* to be pressed against the sheet supply roller 104. The separating side plate 131 can be pivoted around a support shaft 133 and is biased in an anticlockwise direction by means of a spring 134.

When the cassette 103 is unloaded from the printer, an abutment 103*a* of the cassette 103 urges an abutment portion 132*b* of the lever 132, thus rotating the separating side plates 131 around the support shaft 133 in a clockwise direction, whereby the separating means 130 is retracted upwardly. The separating means 130 is held in the retracted position by engaging an end 131*a* of the separating side plate 131 by an engagement portion 135*a* of a locking means 135. A separating means 230 regarding the lower cassette 203 has the same construction as the separating means 130 regarding the upper cassette.

The guide path 108 for guiding the sheet S from the lower cassette 203 to the guide path 106 is arranged in front of the cassette 103 in the cassette loading and unloading direction Y, which guide path 108 is defined by guide plates 108*a*, 108*b* attached to a front door 109. The front door 109 is pivotably mounted on the cassette guide through a hinge (not shown), and can be rotated up to a position 109' where the front door does not interfere with the cassette 103 when the latter is loaded or unloaded (refer to a two-dot and chain position in FIG. 1). Further, the front door 109 has a hook 110, when the operator desires to load or unload the cassette 103, he releases the hook 110 and then opens the front door 109 for loading or unloading the cassette. Accordingly, since the guide path 108 is also opened or retracted upon the opening of the door 109, the sheet from any cassette (in this case, the lower cassette) cannot be fed to the guide path 106 during the loading or unloading operation of the upper cassette 103. As to the lower cassette 203, the construction and operation of a front door 209, hook 210 and the like are the same as those of the front door, hook and the like regarding the upper cassette.

Figure 5:
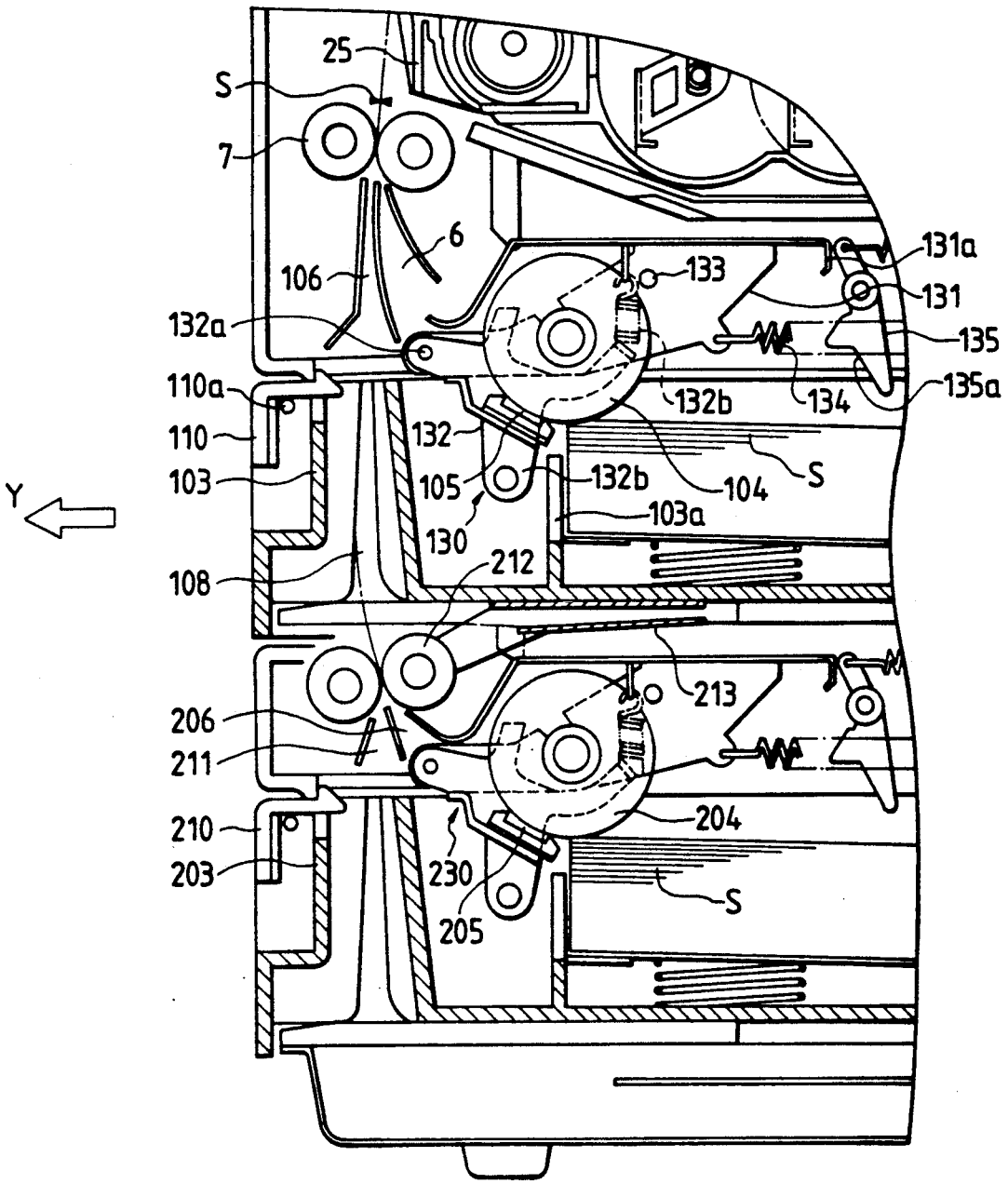
FIG. 5 is a partial sectional view showing a sheet feeding apparatus according to another embodiment of the present invention.

In FIG. 5, although a guide path (corresponding to the guide path 108 regarding the upper cassette 103) which is arranged in front of the lower cassette 203 for guiding the sheet from any lowerer cassette is not clearly shown, if three or more cassettes are used, such guide path may be constructed as same as the guide path 108.

Now, an embodiment of the present invention will be fully explained in connection with FIG. 2. In order to solve the above-mentioned problems, the sheet feeding apparatus shown in FIG. 2 includes a detecting means for detecting the open/close of the front door 109, which detecting means is provided on the front door 109 having the guide path 108 for guiding the sheet from other lowerer cassettes.

The detecting means comprises a microswitch 111 arranged on a lower surface of the printer frame 1. By detecting the presence of an upper surface 109*a* of the front door 109 by means of the microswitch 111, it is possible to know a condition whether the front door 109 is opened or not, i.e., whether the guide path 108 is in a sheet feedable state or not.

Next, an operation of the sheet feeding apparatus of FIG. 2 will be described with reference to a block diagram shown in FIG. 3 and a flow chart shown in FIG. 4.

Figure 3:
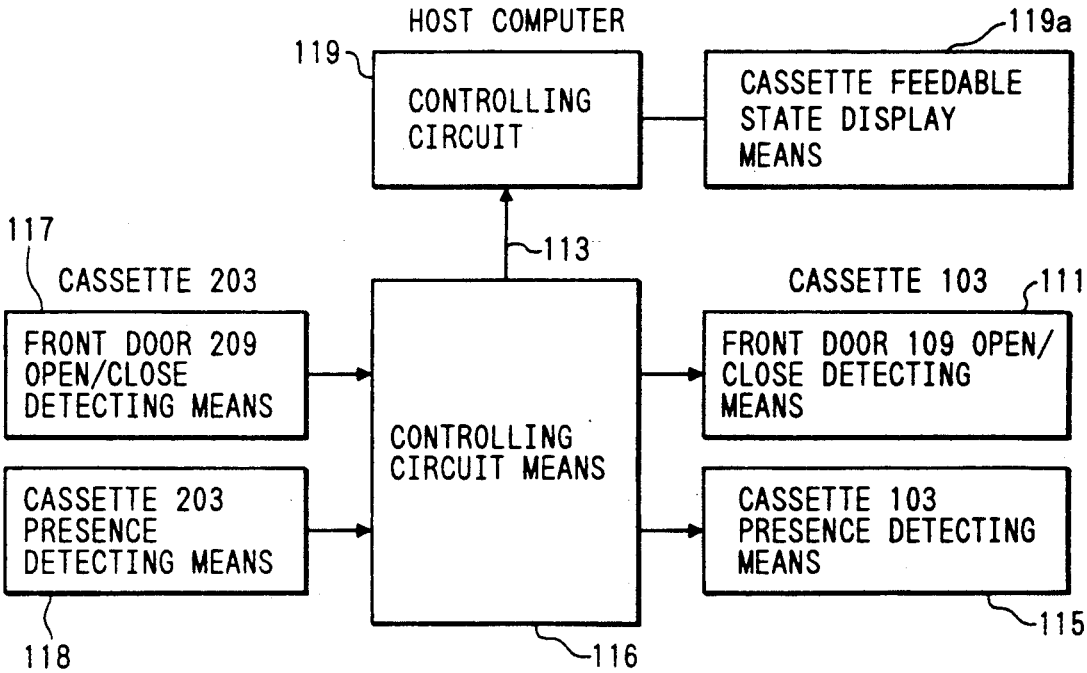
FIG. 3 is a block diagram of a sheet feeding apparatus according to the present invention.

In FIG. 3, the reference numeral 116 designates a controlling circuit means; 111 and 117 designate detecting means for detecting the open/close of the front doors 109 and 209, respectively; and 115 and 118 designate detecting means for detecting conditions whether the cassettes 103 and 203 are loaded or not, respectively. The reference numeral 119 designates a host computer; and 119*a* designates a cassette feedable state display means included in the host computer 119.

The operation of the sheet feeding apparatus will be explained hereinbelow.

Figure 4:
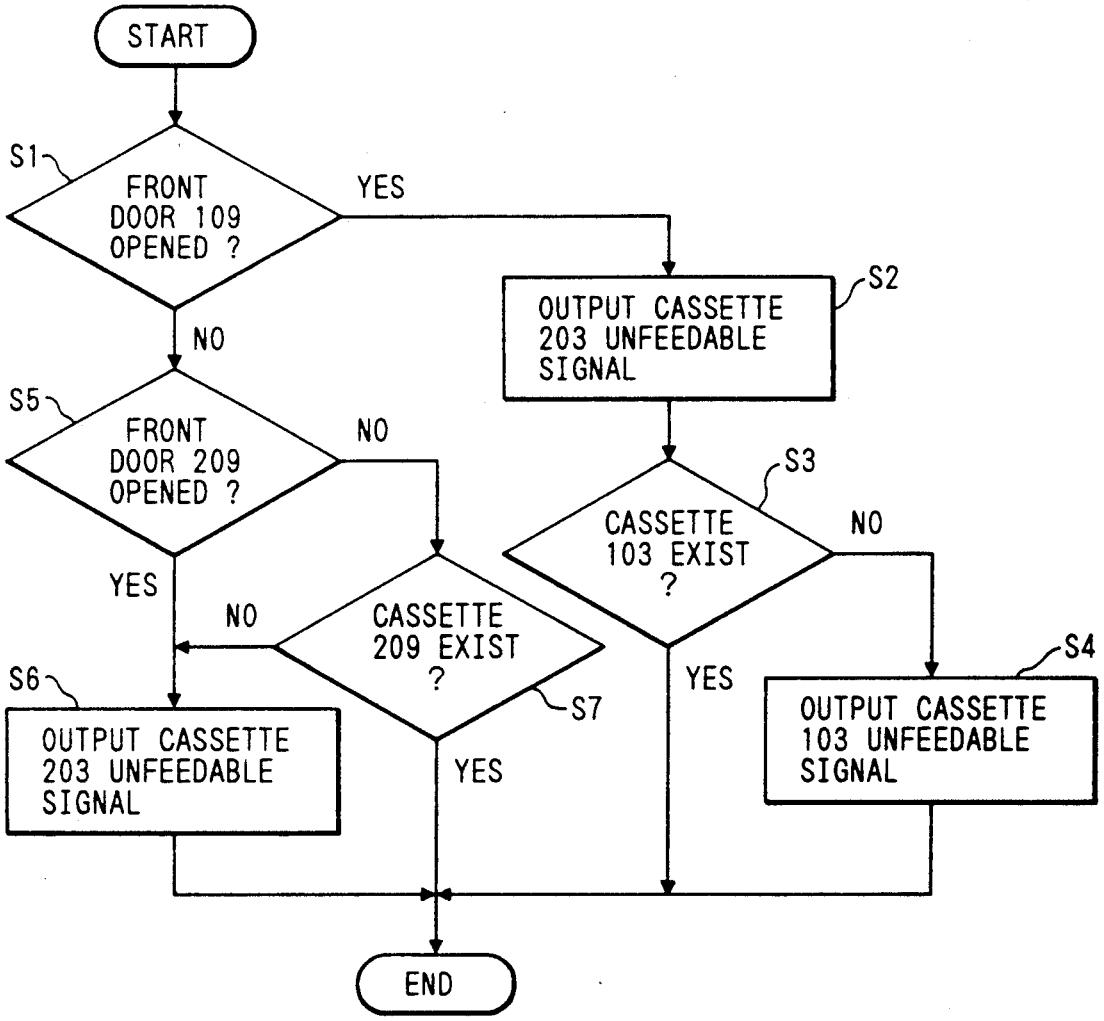
FIG. 4 is a flow chart for executing an operation of the apparatus.

For example, when the front door 109 of the upper cassette 103 is opened, the detecting means 111 detects the fact that the front door is in the opened condition, thereby emitting an alerting signal 112 to the controlling circuit means 116 (in a step S1 in FIG. 4). In this point, the controlling circuit means 116 makes the cassette 203 and other cassettes situated upstream of the opened cassette 103 in the sheet feeding direction unfeedable conditions, and outputs an unfeedable signal 113 to the host computer 119 (in a step S2). Accordingly, the host computer 119 can confirm which cassette or cassettes (the lower cassette 203 in the illustrated embodiment) are in the unfeedable conditions. Such conditions are displayed by the cassette feedable state display means 119*a*. Accordingly, the operator knows the fact that the sheet can be fed from any cassettes (the upper cassette 103 in the illustrated embodiment) downstream of the unfeedable cassette. Then, the presence of the cassette 103 is detected in a step S3, and, if the cassette 103 in absent, a cassette 103 unfeedable signal is outputted. Incidentally, of course, if the front door 109 is closed after the cassette 103 has been unloaded, the guide path 108 will be in the unfeedable condition.

More particularly, when it is judged that the front door 109 is closed in the step S1 and the closed condition of the front door 109 is detected by the detecting means 117 (in a step S5) and the lower cassette 203 exists (in a step S7), a cassette 203 unfeedable signal is not outputted, and accordingly, the sheet can be fed from the lower cassette 203. However, in the step S5, if the opened condition of the front door 209 is detected, the cassette 203 unfeedable signal is outputted. In this case, it may be so designed that, only when the absence of the cassette 203 is confirmed by detecting the presence of the cassette 203, the cassette 203 unfeedable signal is emitted.

The host computer 119 which has received the unfeedable signal may be maintained in a waiting condition without emitting a print command (sheet feeding command) until the unfeedable signal is extinguished. Further, the host computer may emit the sheet feeding command regarding any cassettes which are not associated with the unfeedable signal to print the image on the sheet from that cassette.

In the illustrated embodiment, while an example that the doors are provided and the detecting means for detecting the open/close of the doors are also provided was explained, the doors may be omitted by providing the hook mechanism 101 and the guide path 108 on the grip of the cassette, as shown in FIG. 5.

In this case, the presence or absence of the cassette itself determines the sheet feedable or unfeedable condition of any cassettes positioned upstream of said cassette in the sheet feeding path. Accordingly, a detecting means may be newly provided for detecting the presence of the cassette as in the above-mentioned example, or the presence of the cassette may be detected by using a sheet size detecting means for detecting the size of the sheets received in the cassette. With the arrangement shown in FIG. 5, the front door open/close detecting means shown in the block diagram of FIG. 3 may be omitted, and a detection signal 114 from the cassette presence detecting means is inputted to the controlling circuit means in the printer frame, thereby performing the operation as mentioned above to alert the feedable or unfeedable condition of the cassette to the operator.

Figure 6:
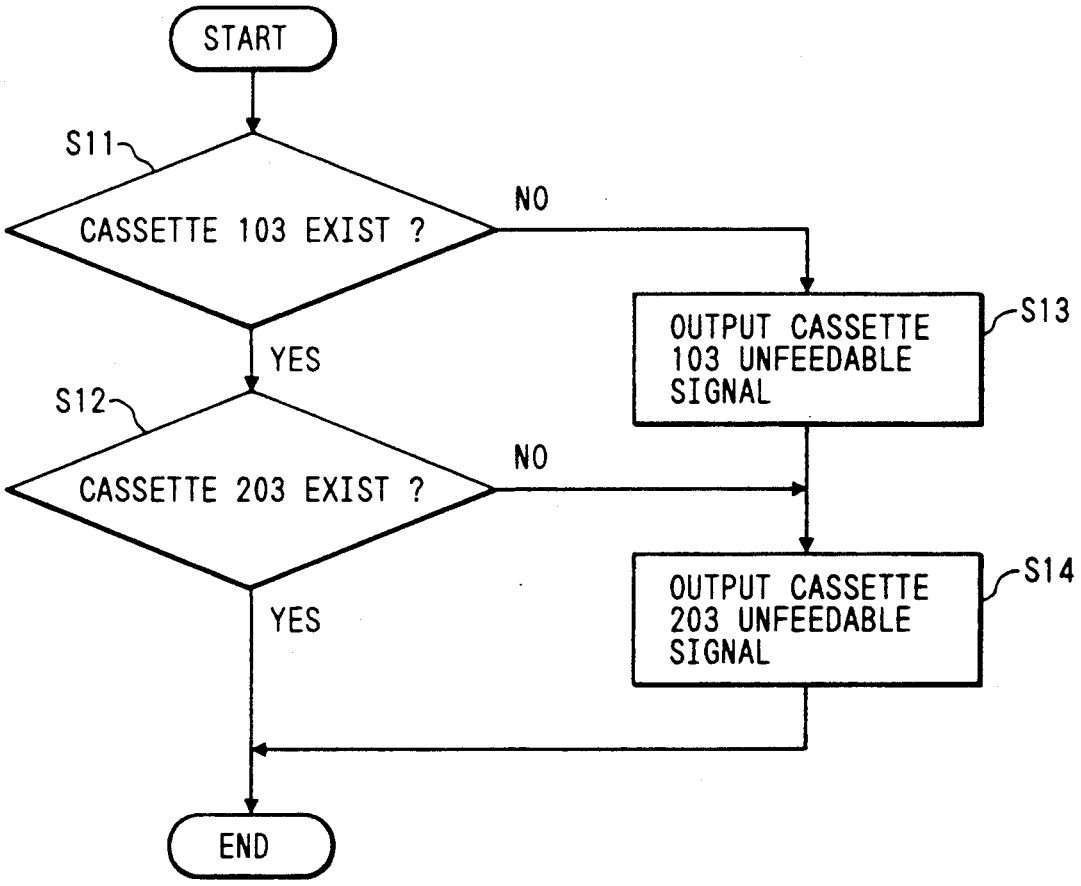
FIG. 6 is a flow chart for executing an operation of the apparatus of FIG. 5.

FIG. 6 shows a flow chart for executing such operation.

If it is judged that the cassette 103 is absent (in a step S11), a cassette 103 unfeedable signal and a cassette 203 unfeedable signal are outputted (in steps S13 and S14). On the other hand, if it is judged that only the cassette 203 is absent (in a step S12), the cassette 203 unfeedable signal is outputted (in the step S14).

Incidentally, in the illustrated embodiment, while an example that only two cassettes are used was explained, three or more cassettes may be used. In this case, if the guide path is in the unfeedable condition when one of the plurality of cassettes is loaded or unloaded, this unfeedable condition may be detected, so as to output the sheet unfeedable signals regarding all of the cassettes positioned upstream of said guide path.

Further, in the illustrated embodiment, while an example that the present invention is applied to the printer was explained, the present invention may be applied to any other image forming system such as a copying machine and the like.

Furthermore, in the above-mentioned embodiments, it may be so designed that the loading and unloading of the sheet accommodating means or the open/close of the door of such sheet accommodating means positioned downstream of the sheet accommodating means from which the sheets are being fed is regulated by providing locking mechanisms on the sheet accommodating means or on the doors thereof.

Figure 7:
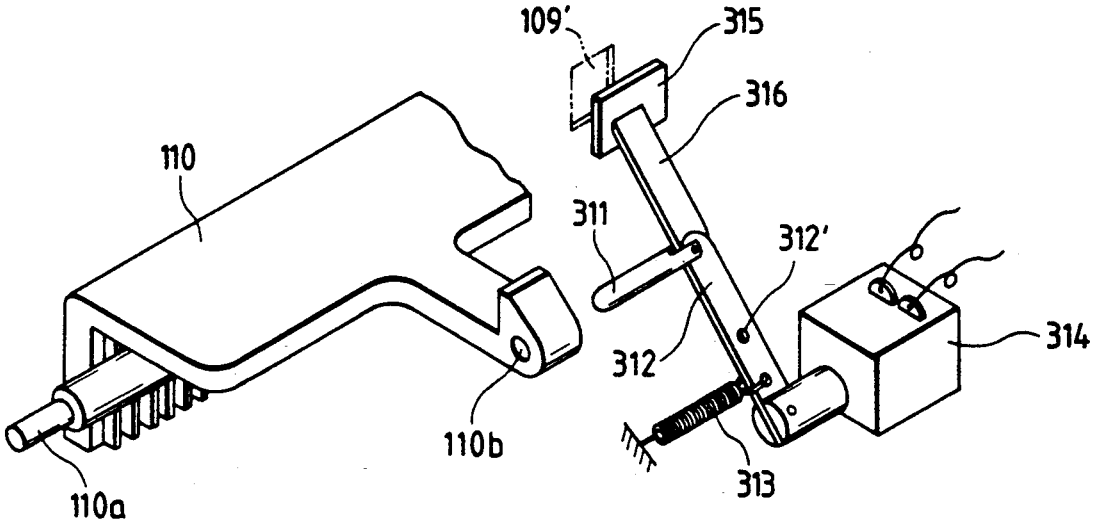
FIGS. 7 and 8 are perspective views showing a further embodiment of the present invention.
Figure 10:
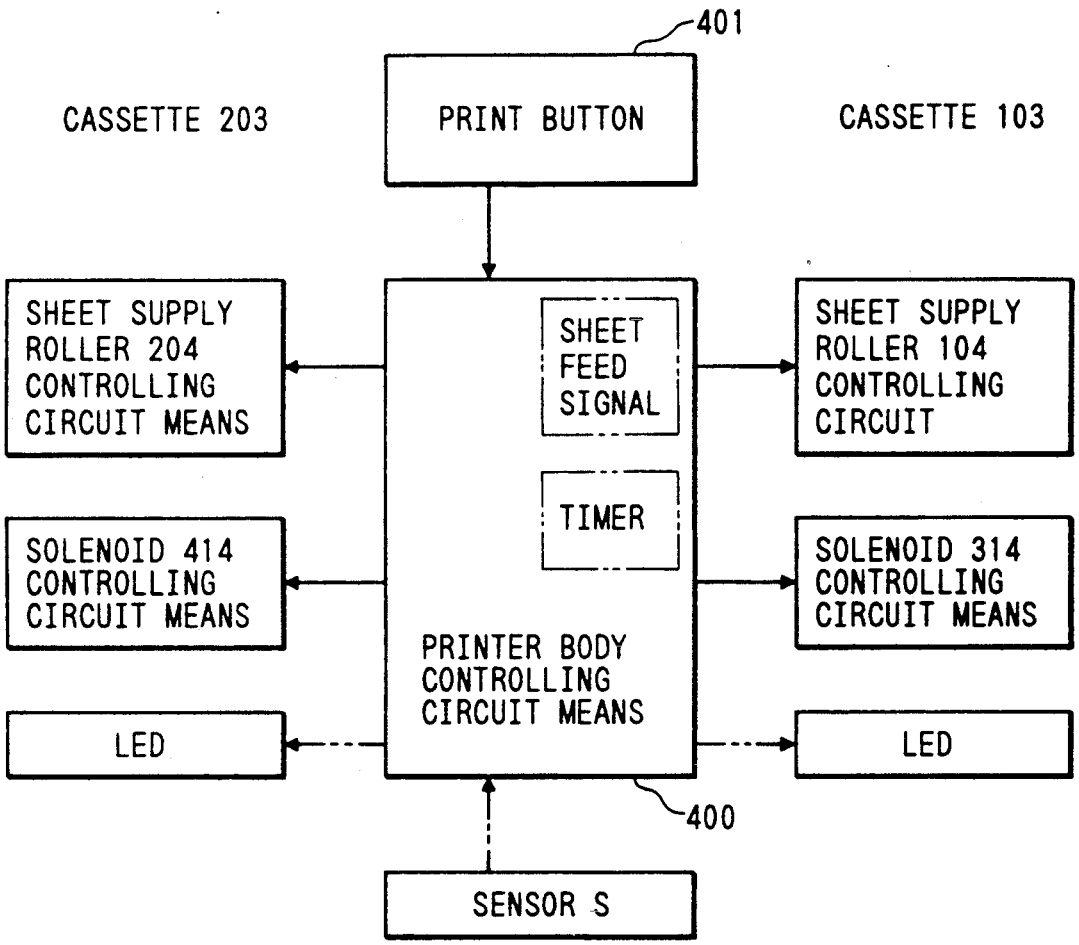
FIG. 10 is a block diagram of the apparatus of FIGS. 7 and 8.

FIG. 7 is a perspective view showing an example that a locking mechanism is provided on the front door 109 of the cassette, and FIG. 10 shows a block diagram of controlling means for controlling the locking mechanism.

A hook 110 has a hinge shaft 110*a* supported by the front door 109 (FIG. 1) and a fit hole 110*b*. On the other hand, a pin 311 which can mate with the fit hole 110*b* is arranged on the cassette guide 107. The pin 311 is fixed to a lever 312 which is in turn attached to a solenoid 314 and which can be rotated around its fit hole 312'. Normally, the lever 312 is biased by a spring 313 in such a manner that the pin 311 is disengaged from the fit hole 110*b* of the hook 110.

Next, the operation of the hook mechanism will be explained. When the sheets S are being fed from the cassette 203, it is necessary that the operator cannot open the front door of this cassette 203 and the door of the cassette 103 positioned downstream of the cassette 203 in the sheet feeding path. Accordingly, when the sheet feedable condition is established (for example, when a copy start button is depressed or when a sheet feed command signal is emitted from the host computer), by energizing the solenoid 314 associated with the front door of the cassette 203 from which the sheets are to be fed and the solenoid 314 associated with the front door of the cassette 103 positioned downstream of the cassette 203 in the sheet feeding path, the lever 312 is rotated around its fit hole 312' to shift the pin 311 in a direction Z, thus fitting the pin 311 into the fit hole 110*b* of the hook 110. Consequently, the hooks 110 are fixedly engaged by the cassette guides 107, 207, thus locking the front doors 109, 209 of the cassettes 103, 203.

The energization of the solenoid 314 may be effected at any time from when the sheet feedable condition is established till the sheet S has just passed through the guide path on the front door of the cassette from which the sheets are fed. For example, when the sheet is fed from the lower cassette 203, the solenoid 314 may be energized during at least the time duration between the point that the printer receives a print start signal from the external host computer to the point that the leading edge of the sheet fed from the lower cassette 203 and passed through the guide path 206 reaches the guide path 108 of the upper cassette 103.

Figure 8:
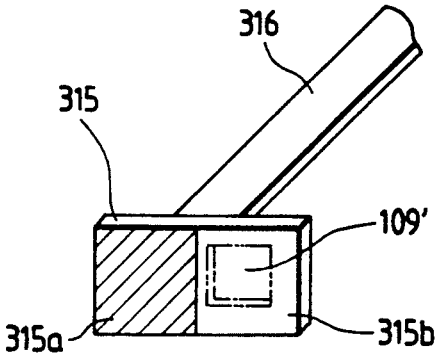

Further, as shown in FIGS. 7 and 8, not only the cassette is locked by the hook 110, but also a displaying means may be provided on the front door of the cassette which cannot be unloaded. More particularly, explaining with respect to FIG. 8, the lever 312 has an extension 316 to a free end of which a plate 315 is fixed. The plate 315 is shiftable in response to the movement of the lever 312 and has one surface including two different colored areas 315*a*, 315*b*. By forming a window 109' in the front door 109, through which the operator can look at the plate 315, the operator can easily judged whether the cassette is locked or not by discriminating the color of the plate 315 presented through the window 109', and accordingly, the danger that the operator forcibly opens the locked door will be avoided.

In this way, by providing the locking mechanism for the front door of each cassette, the possibility of the jamming of the sheet is considerably reduced even if the single printer is used by several operator simultaneously. Further, the following advantages are obtained:

(1) Since the sheet feedable or unfeedable condition can be presented to both of the operators situated near the host computer and the printer, the operator handling the printer can change the size of the sheet and/or replenish the sheets without reserve; and (2) Further, the operator handling the host computer can know the kind of feedable sheets at his position, and accordingly, he can select the desired sheet without taking account of the operator handing the printer.

Alternatively, the locking operation of the front door 109, i.e., the energization of the solenoid 314 may be effected at the following timings, as well as the above-mentioned one:

(1) During the rotation of the sheet supply roller.

(2) During the rotation of the sheet supply roller and during the print signal being turned ON (in case of the printing of plural sheets).

(3) During the time duration point that the sheet feeding operation is started to a time point that the sheet has just passed through the registering rollers 7. In this case, for example, by providing a sensor S (FIG. 1) in the sheet feeding path near the registering rollers 7, a signal from the sensor may be utilized.

(4) During the time duration from a time point that the sheet feeding operation is started to a time point that a predetermined time is elapsed after a vertical synchronous signal is turned ON (for example, to a time point that the trailing edge of the sheet has just passed through the sheet supply roller 104, or the trailing edge of the sheet has just left the cassette moving path). In this case, the timing is determined by a timer T. In practice, it is preferable to determine the timing of the energization of the solenoid by combining two or more above factors.

Figure 11:
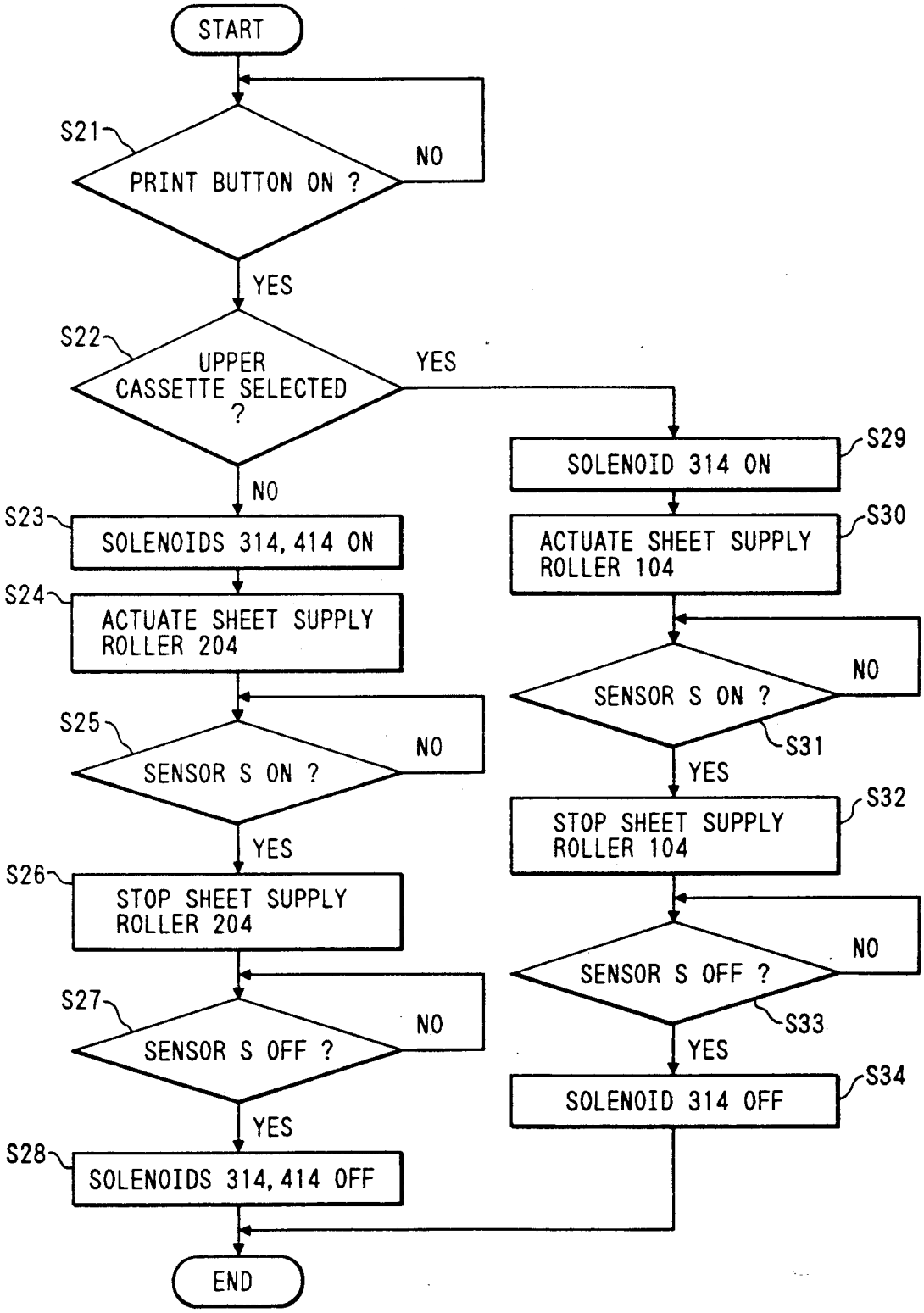
FIG. 11 is a flow chart for executing an operation of the apparatus of FIGS. 7 and 8.

FIG. 10 shows a control block diagram for the locking mechanism, and FIG. 11 shows a control flow chart for the locking mechanism.

In FIG. 11, if the controlling circuit means 400 (FIG. 10) judges that a print start button 401 is depressed or turned ON (in a step S21), it is judged whether the selected cassette is the upper cassette (103) or lower cassette (203) in a step S22. If the selected cassette is the lower cassette, in a step S23, the solenoid 414 (FIG. 10) associated with the front door of the cassette 203 and the solenoid 314 associated with the front door of the cassette 103 are energized or turned ON, thereby locking both front doors of the upper and lower cassettes. In a step S24, the sheet supply roller 204 is activated, thus feeding the sheet from the lower cassette 203. When the sensor S is turned ON, i.e., when the leading edge of the sheet is gripped by the registering rollers 7 in the printer frame 1, the sheet supply roller 204 is deactivated (in a step S25 and S26). When the trailing edge of the sheet has just passed through the sensor S (in a step S27). the solenoid 414 is turned OFF, thus releasing the locking mechanism (in a step S28).

On the other hand, in the step S22, if the upper cassette 103 is selected, only the solenoid 314 is turned ON in the step S29, this locking only the front door of the upper cassette 103. In this case, the lower cassette 203 can be freely unloaded. Subsequently, the sheet can be fed from the upper cassette in the same manner as in the case that the lower cassette is selected.

Incidentally, the indication whether the front door 109 is locked or not may be effected by an appropriate electrical means. For example, at the same time when the solenoid 314 is energized, an illuminating element such as LED arranged on the outer surface of the door may be energized to indicate the locking condition of the door.

Further, in the illustrated embodiment, while an example that the main locking elements (pin 311, lever 312, solenoid 314) are provided on the cassette guide was explained, such locking elements may be provided on the front door of the cassette. Further, the energization of the solenoid 314 may be effected to establish the unlocked condition. In this case, the lever mechanism 312 can be omitted, and the pin 311 directly connected to the solenoid is retracted from the fit hole **110*b* of the hook 110 when the solenoid 314** is energized to release the locking mechanism. However, in this case, since the solenoid must be energized for a relatively long time to completely retract the pin from the fit hole of the hook, the temperature of the solenoid will be increased. Accordingly, any cooling means for cooling the solenoid will be required.

As mentioned above, means for indicating the condition that the cassette cannot unloaded may be either one of the visual display such as the LED or the color indication, and the feeling touch such as the locking mechanism, or may be the combination thereof. In this disclosure, such means including both of the indicating means and the locking means is referred as alarm means or inhibiting means.

Further, in the above-mentioned embodiment, an example that the guide path and the locking mechanism are arranged in the front door was explained, the present invention is not limited to this example. For example, the door may be omitted and the guide path and the locking mechanism may be arranged on the grip of the cassette (FIG. 5). In case of FIG. 5, the hook 100 of the locking mechanism is constituted by the grip of the cassette.

Incidentally, when the guide path is arranged on the cassette, all of the cassettes downstream of the cassette to be used must be loaded in the printer. On the other hand, when the guide path is arranged in the front door, the sheet can be fed from the desired cassette even if the cassettes downstream of the desired cassette are not loaded in the printer. The sheet accommodating means is not limited to the cassette which can be completely separated from the printer, but may be a drawer type constainer which is partially held in the printer even it is fully retracted.

As mentioned above, when the plurality of sheet accommodating means are used, since the front door is provided on each sheet accommodating means and the front doors of the sheet accommodating means from which the sheets are fed and of the sheet accommodating means positioned downstream of said used sheet accommodating means in the sheet feeding path are locked not to be opened during the sheet feeding operation and further the locked condition of the door can be indicated to the operator, the following merits can be obtained:

(a) The jamming of the sheet and/or the poor printing caused by loading or unloading the cassette during the sheet feeding operation can be prevented; and (b) The operator can know the cassette or cassettes which can be loaded or unloaded, and, accordingly, he can trust to exchange the cassettes even if the single printer is used by the several operators, thus improving the operability.

Further, since not only the above problems can be eliminated, but also the sheet feeding path can be arranged substantially in the vertical direction, the sheet feeding ability is improved, thus obtaining the highly reliable image forming system.

Figure 12:
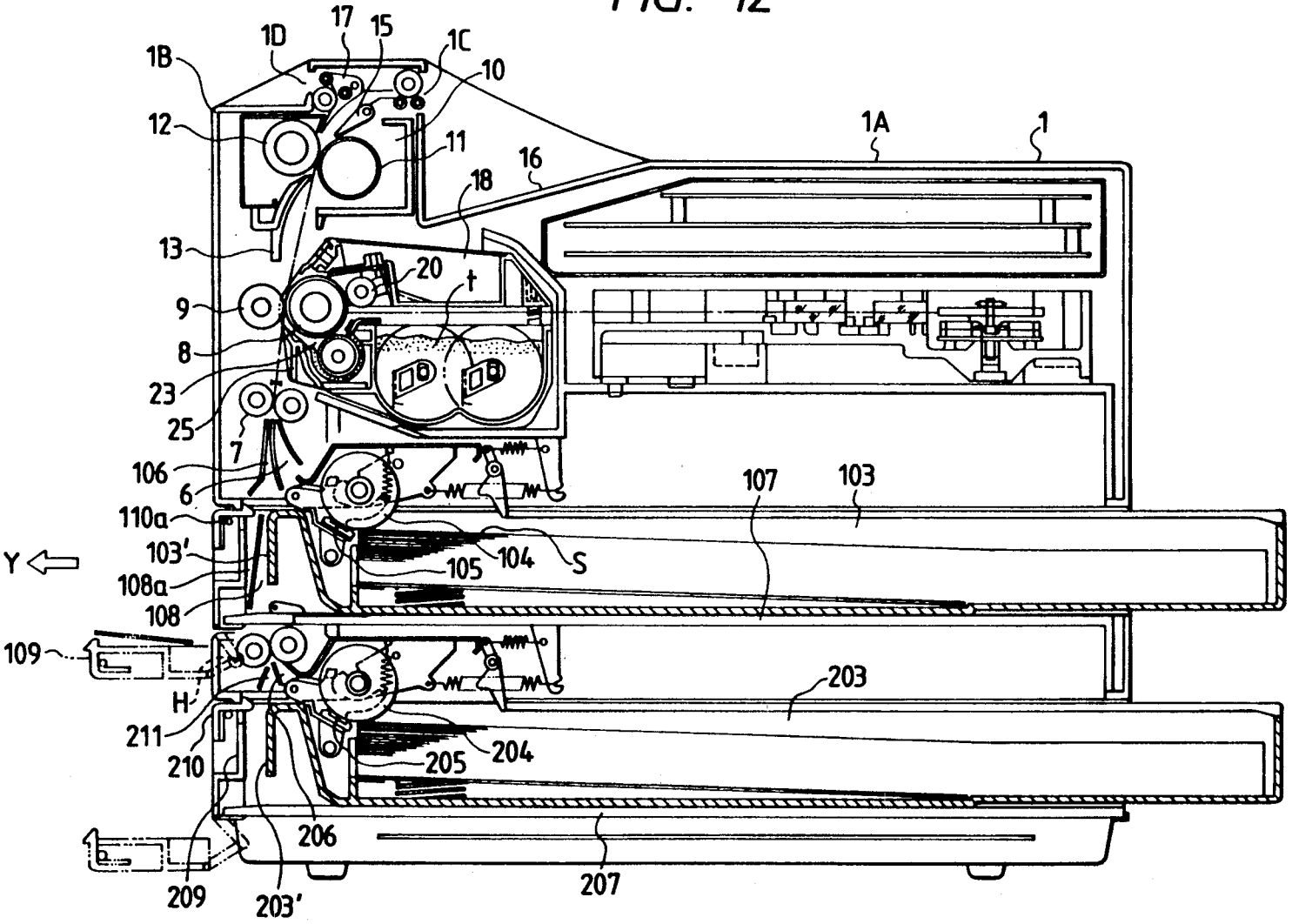
FIG. 12 is an elevational sectional view of a sheet feeding apparatus according to a further embodiment of the present invention.
Figure 13:
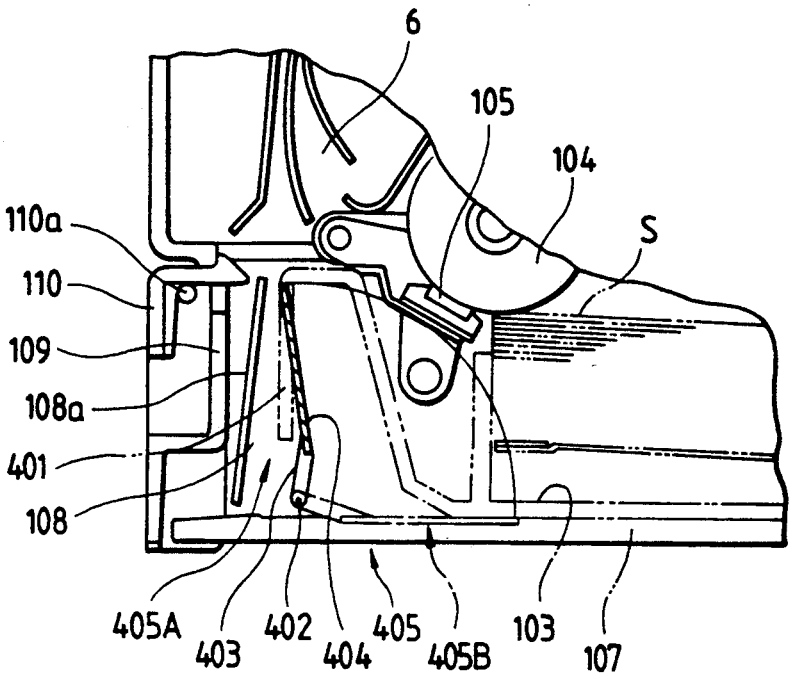
FIG. 13 is a partial sectional view showing a detailed portion of the apparatus of FIG. 12.

Next, a further embodiment of the present invention will be explained with reference to FIGS. 12 and 13. FIG. 12 shows an elevational sectional view of a image forming system incorporating a sheet feeding apparatus according to a further embodiment of the present invention, wherein the same elements as those in the previous embodiments are designated by the same reference numerals used in the previous embodiments. FIG. 13 shows a main portion of the sheet feeding apparatus associated with the cassette 103.

A guide path 108 for guiding a sheet S fed from a lower cassette 203 can be divided into two parts, by designing that the guide path 108 is defined by a guide plate 108*a* fixed to a door 109 of a cassette 103 and an outer face of a grip of the cassette 103. Further, a pivot shaft 402 is fixed to the printer frame in parallel to the guide plate 108*a* and near the lower inner portion of the latter. A guide plate 404 is fixedly mounted on a lever 403 having a base end fixed to both ends of the pivot shaft 402. The guide plate 404 is biased in an anticlockwise direction (FIG. 13) by means of a spring (not shown) arranged around the pivot shaft 402. The pivot shaft 402, lever 403 guide plate 404 and the spring (not shown) constitute a guide portion 405.

FIG. 13 shows a condition that the upper cassette 103 is unloaded. In this condition, the guide plate 404 has been rotated in a guide position 405A shown by a solid line in FIG. 13 by the bias force of the spring to abut against a stopper (not shown). In this condition, the guide plate 404 faces the guide plate 108*a* integral with the front door 109, thus defining the guide path 108. Further, as shown in FIG. 12, as the cassette 103 is inserted into the printer, the guide plate 404 is pushed down by the cassette 103 to reach a retracted position 405B as shown in FIG. 13. After the cassette 103 has been loaded, the outer face of the grip 401 of the cassette faces the guide plate 108*a*, thus defining the guide path 108 as mentioned above.

Then, when the upper cassette 103 is being unloaded, as the trailing end of the cassette 103 leaves the guide plate 404, the latter is rotated in the anticlockwise direction by the spring force toward the guide position 405A. Accordingly, even after the cassette 103 has been unloaded from the printer frame 1, the guide path 108 can be maintained by the combination of the guide plate 108*a* and the guide plate 404 facing therewith.

Further, if the jamming of the sheet occurs in the guide path 108, when the front door 109 is opened, since the guide plates 108*a* and 404 are not moved altogether, but only the guide plate 108*a* is rotated, the sheet S is not damaged or is not held partially in the printer frame 1 in the jammed sheet removal operation. Further, it is not feared that the jammed sheet S is trapped in the guide path 108 to make the treatment of the sheet difficult. Since the guide plate 108*a* movable to open the guide path 108 arranged on one side of the guide path, it is not required for opening the front door largely to open the guide path, which makes the construction simpler.

In addition, by engaging the cassette by the guide plate 404 at an area of the guide plate which does not contribute to define the guide path 108, the guiding surface of the guide plate 404 is not damaged or scratched, thereby ensuring the sheet feeding ability by the guide path constituted by the guide plate 404.

Figure 14:
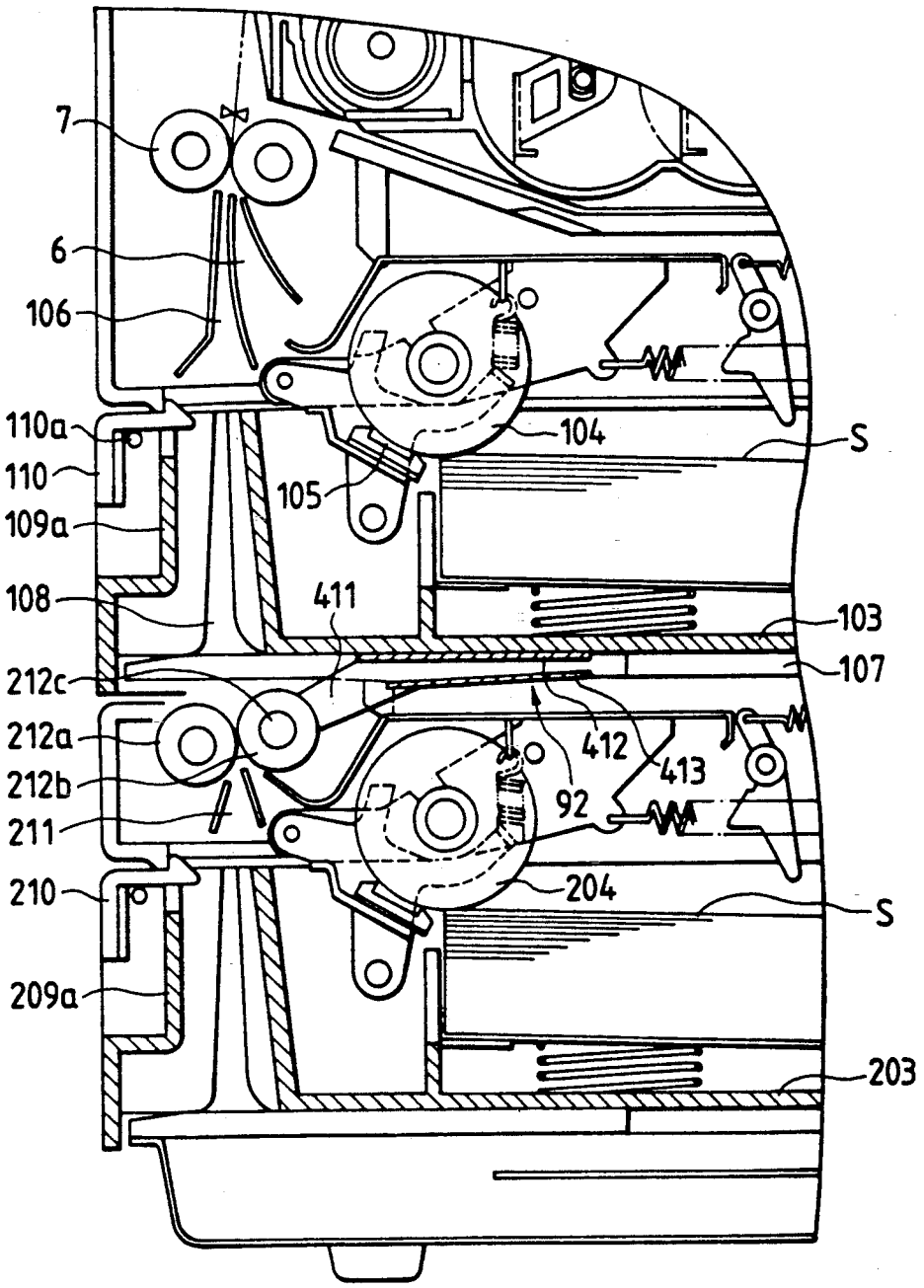

FIG. 14 shows a further embodiment of the present invention.

A cassette 103 shown in FIG. 14 does not include the openable front door 109 as mentioned above, but includes a fixed front door 109*a*. A guide path 108 as a sheet feeding passage for guiding the sheet S fed from a lower cassette 203 is formed in the cassette 103.

A guide portion arranged in the sheet feeding mechanism for feeding the sheet from the lower cassette 203 comprises a pair of levers 411, guide plates 412, 413 fixedly mounted between the levers 411, and a torsion spring (not shown) for biasing these elements 411–413 in an anticlockwise direction (FIG. 14). The base ends of the levers 411 are pivotally connected to a roller shaft 212*c* of one (212*b*) of sheet feeding rollers 212*a*, 212*b* for feeding the sheet from the lower cassette. When the cassette 103 is loaded into the printer frame 1, the guide plates 412, 413 are pressed down as shown by the bottom surface of the cassette 103.

When the upper cassette 103 is being unloaded from the printer, as the trailing end of the cassette leaves the guide plates 412, 413, these guide plates are rotated around the shaft 212*c* in the anticlockwise direction by the bias force of the torsion spring (not shown). When the cassette 103 is unloaded from the printer completely, the guide plates 412, 413 are abutted against stoppers (not shown) provided on the printer frame 1, whereby the guide plates are held in a predetermined position (where the sheet S can be directed to the guide path 106). Accordingly, even if the cassette 103 does not exist in the printer frame 1, the guide path 108 as the sheet feeding passage for guiding the sheet S from the lower cassette 203 can be established.

Figure 15:
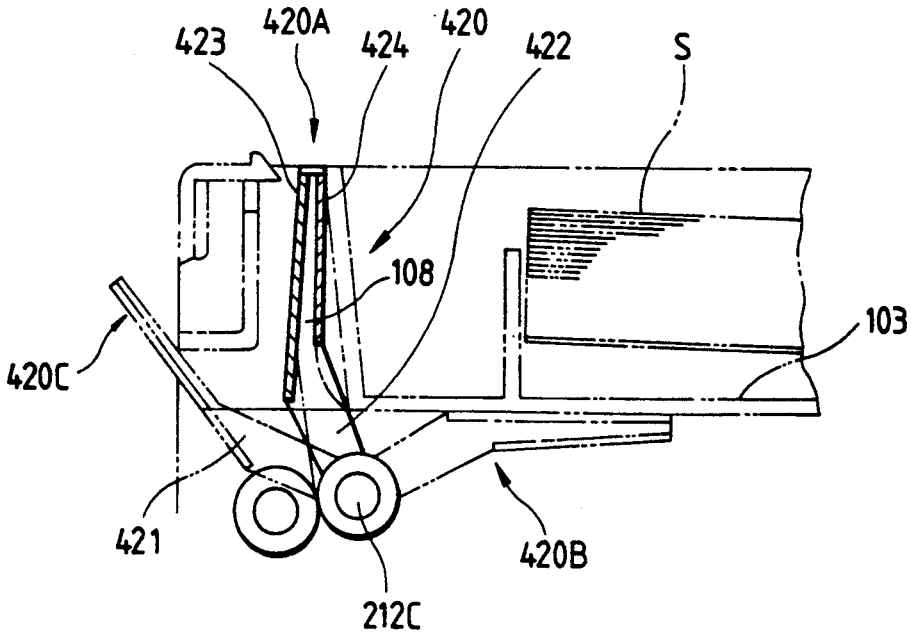
FIGS. 14 and 15 are partial sectional view of a sheet feeding apparatus according to the other embodiments of the present invention.

FIG. 15 shows the other embodiment of the present invention.

In FIG. 15, a pair of levers 421, 422 included in a guide portion 420 are pivotably mounted on the roller shaft 212*c*, respectively. The levers 421, 422 have guide plates 423, 424 fixed thereto, respectively. The guide plate 424 is biased toward an anticlockwise direction (FIG. 15) by means of a torsion spring (not shown). Further, the lever 421 is also biased toward the guide plate 424 by means of a spring (not shown) weaker than the above-mentioned torsion spring.

When the cassette 103 is loaded in the printer frame 1 as shown by the two-dot and chain line in FIG. 15, the guide plates 423, 424 has been pressed down by the cassette 103 to take a retracted position 420B. When the cassette 103 is unloaded from the printer, the guide plates 423, 424 are returned to a guiding position 420A shown by the solid line in FIG. 15, thereby defining the guide path 108 for guiding the sheet S from the lower cassette 203. When the jamming of the sheet occurs in the guide path 108, only the outer guide plate 423 can be further rotated to a retarded position 420C. With this arrangement, the sheet jammed between the guide plates 423 and 424 can be easily removed from the guide path 108 by rotating the guide plate 424 to the retarded position.

Incidentally, a support structure for supporting the guide plates 404, 412, 413, 423, 424 and the like defining the guide path after the upper cassette 103 has been unloaded may be arranged on either cassette guide associated with the unloaded cassette or cassette guide associated with the upstream or downstream cassette.

Further, in the illustrated embodiments, while an image forming system having a sheet feeding path extending vertically was explained, the present invention can be applied to any image forming system having other sheet feeding path across which the cassette is loaded and unloaded.

Further, in the illustrated embodiments, while the cassette which can completely separated from the printer was explained, any other slidable cassettes such as drawers, which can be slidably shifted to replenish the sheets may be used.

What is claimed is:

1. A sheet feeding apparatus comprising:

a first sheet accommodating means shiftable in a predetermined direction from a sheet supply position for supplying a sheet;

a first sheet supply means for feeding out the sheet from said first sheet accommodating means positioned in said sheet supply position;

a second sheet accommodating means for accommodating sheets;

a second sheet supply means for feeding out the sheet from said second sheet accommodating means;

a guide means movable between a first position intersecting the shifting direction of said first sheet accommodating means for guiding the sheet fed out by said second sheet supply means and a second position for not guiding the sheet; and an inhibiting means for inhibiting the shifting of said first sheet accommodating means in response to the feeding out of a sheet from said second sheet supply means when said guide means is in the first position.

2. A sheet feeding apparatus according to claim 1, wherein said inhibiting means includes a preventing member for preventing the movement of said first sheet accommodating means.

3. A sheet feeding apparatus according to claim 1, wherein said inhibiting means includes a display portion for indicating the inhibitation of the shift of said first sheet accommodating means.

4. A sheet feeding apparatus according to claim 1, further including a support means for supporting said guide means for movement between said first and second positions.

5. A sheet feeding apparatus according to claim 1, wherein said guide means is formed integrally with said first sheet accommodating means.

6. A sheet feeding apparatus according to claim 1, further including a detecting means for detecting passage of the sheet through said guide means and emitting a detection signal.

7. A sheet feeding apparatus according to claim 6, wherein said inhibiting means inhibits the shifting of said first sheet accommodating means in response to the detection signal from said detecting means.

8. A sheet feeding apparatus according to claim 6, wherein said detecting means emits the detection signal in response to activation of said second sheet supply means.

9. A sheet feeding apparatus according to claim 6, wherein said detecting means emits the signal on the basis of a sheet feeding command signal for said second sheet supply means.

10. A sheet feeding apparatus comprising:

a first sheet accommodating means shiftable in a predetermined direction from a sheet supply position for supplying a sheet;

a first sheet supply means for feeding out the sheet from said first sheet accommodating means positioned in said sheet supply position;

a second sheet accommodating means for accommodating sheets;

a second sheet supply means for feeding out the sheet from said second sheet accommodating means; and a guide means movable between a first position intersecting the shifting direction of said first sheet accommodating means for guiding the sheet fed out by said second sheet supply means and a second position for allowing the shifting of said first sheet accommodating means.

11. A sheet feeding apparatus according to claim 10, wherein said guide means includes a pair of guide members.

12. A sheet feeding apparatus according to claim 11, wherein said guide members are pivotably mounted.

13. A sheet feeding apparatus according to claim 11, wherein one of said paired guide members is common with a portion of said first sheet accommodating means.

14. A sheet feeding apparatus according to claim 13, further including a second guide member cooperating with the other of said paired members to guide the sheet when said first sheet accommodating means is shifted in the predetermined position.

15. A sheet feeding apparatus according to claim 14, wherein said second guide member is rotatable.

16. A sheet feeding apparatus comprising:

a first sheet accommodating means shiftable in a predetermined direction from a sheet supply position for supplying a sheet;

a first sheet supply means for feeding out the sheet from said first sheet accommodating means positioned in the sheet supply position;

a second sheet accommodating means for accommodating sheets;

a second sheet supply means for feeding out the sheet from said second sheet accommodating means;

a first guide means provided integral with said first sheet accommodating means to intersect the shifting direction of said first sheet accommodating means, said first guide means for guiding the sheet fed out from said second sheet accommodating means; and a second guide means for guiding the sheet for said first guide means when said first sheet accommodating means is shifted in the predetermined direction.

17. A sheet feeding apparatus according to claim 16, wherein said second guide means is rotatable.

18. A sheet feeding apparatus, comprising:

a first sheet accommodating means shiftable in a predetermined direction from a sheet supply position for supplying a sheet;

a first sheet supply means shiftable between a feed-out position for feeding out the sheet from said first sheet accommodating means and retracted position for allowing the shift of said first sheet accommodating means in the predetermined direction;

a second sheet accommodating means for accommodating the sheets;

a second sheet supply means for feeding out the sheet from said second sheet accommodating means; and a guide path provided integral with said first sheet accommodating means to intersect the shift direction thereof, said guide path for guiding the sheet fed out from said second sheet accommodating means.

19. A sheet feeding apparatus according to claim 18, further including a detection means for detecting passage of the sheet through said guide path and for emitting a detection signal, and an inhibiting means for inhibiting the shift of said first sheet accommodating means in response to the detection signal from said detecting means.

20. A sheet feeding apparatus according to claim 18, further including a signal generating means for detecting when said first sheet accommodating means is not in the supply position and emitting a signal indicating an unfeedable condition of said second sheet supply means.

21. A sheet feeding apparatus according to claim 18, wherein said first sheet supply means has a rotary feeding member and a separating pad.

22. A sheet feeding apparatus comprising:

a first sheet accommodating means shiftable in a predetermined direction from a sheet supply position for supplying a sheet;

a first sheet supply means for feeding out the sheet from said first sheet accommodating means positioned in the sheet supply position;

a second sheet accommodating means for accommodating sheets therein;

a second sheet supply means for feeding out the sheet from said second sheet accommodating means; and a guide path provided apart from said first sheet accommodating means to intersect the shift direction of said first sheet accommodating means as said first sheet accommodating means is shifted from the sheet supply position in the predetermined direction, said guide path for guiding the sheet fed out from said second sheet accommodating means.

23. A sheet feeding apparatus according to claim 22, further including a guide member movable between a first position intersecting the shifting direction of said first sheet accommodating means and where guiding the sheet fed out by said second sheet supply means and a second position where allowing the shift of said first sheet accommodating means.

24. A sheet feeding apparatus according to claim 23 further including a detection means for detecting passage of the sheet through said guide member and emitting a detection signal, and an inhibiting means for inhibiting the shift of said first sheet accommodating means in response to the detection signal from said detecting means.

25. A sheet feeding apparatus according to claim 23, further including a signal generating means for detecting said guide member being in the position where allowing the shift of said first sheet accommodating means and for emitting a signal indicating an unfeedable condition of said second sheet supply means.

26. A sheet feeding apparatus according to any one of claims 1, 10, 16, 18 or 22, wherein the sheet feeding out direction by said first sheet supply means and the shift direction of said first sheet accommodating means from the supply position in the predetermined direction are identical to each other.

27. A sheet feeding apparatus according to any one of claims 1, 10, 18 or 22, wherein said second sheet accommodating means is shiftable from a supply position for sheet supplying to a predetermined position.

28. A sheet feeding apparatus comprising:

a first sheet accommodating means shiftable in a predetermined direction from a sheet supply position for supplying a sheet;

a first sheet supply means for feeding out the sheet from said first sheet accommodating means positioned in said sheet supply position;

a second sheet accommodating means for accommodating sheets;

a second sheet supply means for feeding out the sheet from said second sheet accommodating means;

a guide means movable between a first position intersecting the shifting direction of said first sheet accommodating means for guiding the sheet fed out by said second sheet supply means and a second position for not guiding the sheet; and a signal generating means for detecting the presence of said guide means in said second position and for emitting a signal indicating an unfeedable condition of said second sheet supply means, wherein said first sheet supply means is shiftable between a feed-out position where feeding out the sheet from said first sheet accommodating means and a retracted position where allowing the shift of said first sheet accommodating means to the predetermined position.

29. A sheet feeding apparatus, comprising:

a first sheet accommodating means shiftable in a predetermined direction from a sheet supply position for supplying a sheet;

a first sheet supply means for feeding out the sheet from said first sheet accommodating means positioned in said sheet supply position;

a second sheet accommodating means for accommodating sheets;

a second sheet supply means for feeding out the sheet from said second sheet accommodating means;

a guide path intersecting the shifting direction of said first sheet accommodating means and for guiding the sheet fed out by said second sheet supply means; and an inhibiting means for inhibiting the shifting of said first sheet accommodating means in response to the feeding out of a sheet from said second sheet supply means.

30. An image forming system, comprising:

a first sheet accommodating means shiftable in a predetermined direction from a sheet supply position for supplying a sheet;

a first sheet supply means for feeding out the sheet from said first sheet accommodating means position in said sheet supply position;

a second sheet accommodating means for accommodating sheets;

a second sheet supply means for feeding out the sheet from said second sheet accommodating means;

a guide path intersecting the shifting direction of said first sheet accommodating means and for guiding the sheet fed out by said second sheet supply means;

an inhibiting means for inhibiting the shifting of said first sheet accommodating means in response to the feeding out of a sheet from said second sheet supply means; and an image forming means for forming an image on the sheet fed by one of said first sheet supply means and said second sheet supply means.

31. An image forming system, comprising:

a first sheet accommodating means shiftable in a predetermined direction from a sheet supply position for supplying a sheet;

a first sheet supply means for feeding out the sheet from said first sheet accommodating means positioned in said sheet supply position;

a second sheet accommodating means for accommodating sheets;

a second sheet supply means for feeding out the sheet from said second sheet accommodating means;

a guide means movable between a first position intersecting the shifting direction of said first sheet accommodating means for guiding the sheet fed out by said second sheet supply means and a second position where said guide means is allowing the shifting of said first sheet accommodating means; and an image forming means for forming an image on the sheet fed by one of said first sheet supply means and said second sheet supply means.

32. An image forming system, comprising:

a first sheet accommodating means shiftable in a predetermined direction from a sheet supply position for supplying a sheet;

a first sheet supply means for feeding out the sheet from said first sheet accommodating means positioned in the sheet supply position;

a second sheet accommodating means for accommodating sheets;

a second sheet supply means for feeding out the sheet from said second sheet accommodating means;

a first guide means provided integral with said first sheet accommodating means to intersect the shifting direction of said first sheet accommodating means, for guiding the sheet fed out from said second sheet accommodating means;

a second guide means for guiding the sheet for said first guide means when said first sheet accommodating means is shifted in the predetermined direction; and an image forming means for forming an image on the sheet fed by said first sheet supply means or said second sheet supply means.

33. An image forming system, comprising:

a first sheet accommodating means shiftable in a predetermined direction from a sheet supply position for supplying a sheet;

a first sheet supply means shiftable between a feed-out position for feeding out the sheet from said first sheet accommodating means and a retracted position for allowing the shift of said first sheet accommodating means in the predetermined direction;

a second sheet accommodating means for accommodating the sheets;

a second sheet supply means for feeding out the sheet from said second sheet accommodating means;

a guide path provided integral with said first sheet accommodating means to intersect the shift direction thereof, said guide path for guiding the sheet fed out from said second sheet accommodating means; and an image forming means for forming an image on the sheet fed by one of said first sheet supply means and said second sheet supply means.

34. An image forming system, comprising:

a first sheet accommodating means shiftable in a predetermined direction from a sheet supply position for supplying a sheet;

a first sheet supply means for feeding out the sheet from said first sheet accommodating means positioned in the sheet supply position;

a second sheet accommodating means for accommodating sheets therein;

a second sheet supply means for feeding out the sheet from said second sheet accommodating means;

a guide path provided apart from said first sheet accommodating means to intersect the shift direction of said first sheet accommodating means, said guide path for guiding the sheet fed out from said second sheet accommodating means; and an image forming means for forming an image on the sheet fed by said first sheet supply means or said second sheet supply means.

* * * * *

UNITED STATES PATENT AND TRADEMARK OFFICE

CERTIFICATE OF CORRECTION

PATENT NO. : 5,155,537

DATED : October 13, 1992

INVENTOR(S) : TERUO KOMATSU, ET AL.

It is certified that error appears in the above-identified patent and that said Letters Patent is hereby corrected as shown below:

COLUMN 1

Line 19, "been" should be deleted.

COLUMN 8

Line 51, "judged" should read --judge--.

COLUMN 9

Line 11, "duration" should read --duration from a time--.
Line 52, "this" should read --thus--.

COLUMN 10

Line 13, "cannot" should read --cannot be--.
Line 24, "omitted" should read --omitted,--.

UNITED STATES PATENT AND TRADEMARK OFFICE

CERTIFICATE OF CORRECTION

PATENT NO. : 5,155,537

DATED : October 13, 1992

INVENTOR(S) : TERUO KOMATSU, ET AL.

It is certified that error appears in the above-identified patent and that said Letters Patent is hereby corrected as shown below:

COLUMN 12

Line 67, "can" should read --can be--.

COLUMN 14

Line 17, "position" should read "direction".

Signed and Sealed this

Thirtieth Day of November, 1993

Bruce Lehman

BRUCE LEHMAN

*Commissioner of Patents and Trademarks*

*Attest:*

*Attesting Officer*